US010087383B2

(12) United States Patent
McAfee et al.

(10) Patent No.: US 10,087,383 B2
(45) Date of Patent: Oct. 2, 2018

(54) AVIATION FUEL ADDITIVE SCAVENGER

(71) Applicant: Afton Chemical Corporation, Richmond, VA (US)

(72) Inventors: Zachary John McAfee, Richmond, VA (US); Joseph Anthony Calderone, III, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 15/083,890

(22) Filed: Mar. 29, 2016

(65) Prior Publication Data

US 2017/0283728 A1 Oct. 5, 2017

(51) Int. Cl.

| | |
|---|---|
| ***C10L 10/04*** | (2006.01) |
| ***F02B 47/04*** | (2006.01) |
| ***C10L 1/14*** | (2006.01) |
| *C10L 1/19* | (2006.01) |
| *C10L 1/20* | (2006.01) |
| *C10L 1/223* | (2006.01) |
| *C10L 1/26* | (2006.01) |
| *C10L 1/30* | (2006.01) |
| *C10L 10/10* | (2006.01) |

(52) U.S. Cl.

CPC ..... *C10L 10/04* (2013.01); *C10L 1/14* (2013.01); *F02B 47/04* (2013.01); *C10L 1/191* (2013.01); *C10L 1/1905* (2013.01); *C10L 1/1915* (2013.01); *C10L 1/201* (2013.01); *C10L 1/202* (2013.01); *C10L 1/223* (2013.01); *C10L 1/2608* (2013.01); *C10L 1/2641* (2013.01); *C10L 1/305* (2013.01); *C10L 10/10* (2013.01); *C10L 2200/0236* (2013.01); *C10L 2200/043* (2013.01); *C10L 2230/22* (2013.01); *C10L 2270/04* (2013.01); *C10L 2290/24* (2013.01)

(58) Field of Classification Search

CPC combination set(s) only.
See application file for complete search history.

(56) References Cited

U.S. PATENT DOCUMENTS

| | | | |
|---|---|---|---|
| 2,399,805 | A | 5/1946 | Hurley et al. |
| 2,479,902 | A | 8/1949 | Callingaert et al. |
| 2,797,153 | A | 6/1957 | Bereslavsky |
| 2,818,417 | A | 12/1957 | Brown et al. |
| 2,860,958 | A | 11/1958 | Gilbert |
| 2,889,212 | A | 6/1959 | Yust et al. |
| 2,911,431 | A | 11/1959 | Orloff et al. |
| 3,013,039 | A | 12/1961 | Lambert |
| 3,023,092 | A | 2/1962 | Hook et al. |
| 3,030,009 | A | 4/1962 | Neidhardt et al. |
| 3,030,396 | A | 4/1962 | Gorsich |
| 3,034,877 | A | 5/1962 | Popkin |
| 3,037,038 | A | 5/1962 | Johnston et al. |
| 3,038,791 | A | 6/1962 | Orloff et al. |
| 3,042,699 | A | 7/1962 | Dayton |
| 3,052,528 | A | 9/1962 | Roddick et al. |
| 3,054,740 | A | 9/1962 | Schroll |
| 3,055,925 | A | 9/1962 | Hartle |
| 3,056,667 | A | 10/1962 | Payne et al. |
| 3,060,009 | A | 10/1962 | Hook et al. |
| 3,063,819 | A | 11/1962 | Watt et al. |
| 3,065,742 | A | 11/1962 | Kawahara et al. |
| 3,070,430 | A | 12/1962 | Lovett et al. |
| 3,088,814 | A | 5/1963 | Gorsich et al. |
| 3,092,646 | A | 6/1963 | Wilkinson |
| 3,113,005 | A | 12/1963 | Gilbert |
| 3,127,351 | A | 3/1964 | Brown et al. |
| 3,130,215 | A | 4/1964 | Schroll |
| 3,160,592 | A | 12/1964 | Brown |
| 3,372,200 | A | 3/1968 | Stern, Jr. et al. |
| 3,418,091 | A | 12/1968 | Barusch et al. |
| 3,442,361 | A | 5/1969 | Gluckstein |
| 3,522,023 | A | 7/1970 | Norton |
| 3,558,292 | A | 1/1971 | Abowd |
| 3,560,174 | A | 2/1971 | Newman et al. |
| 3,615,293 | A | 10/1971 | Hnizda |
| 3,658,497 | A | 4/1972 | Sung et al. |
| 3,966,429 | A | 6/1976 | Sprague et al. |
| 4,005,993 | A | 2/1977 | Niebylski et al. |
| 4,390,345 | A | 6/1983 | Somorjai |
| 4,720,288 | A | 1/1988 | Croudace et al. |
| 5,470,358 | A | 11/1995 | Gaughan |

(Continued)

FOREIGN PATENT DOCUMENTS

| | | | |
|---|---|---|---|
| AU | 732980 | C | 3/2002 |
| AU | 2003252892 | A1 | 11/2003 |

(Continued)

OTHER PUBLICATIONS

Examination Report No. 1 for corresponding AU Application No. AU 2017201950 dated Sep. 11, 2017.
Examination Report No. 1 for corresponding AU Application No. AU 2017201887 dated Sep. 11, 2017.
European Search Report, European Application No. 17161575.0, dated Jul. 10, 2017, 8 pages.
Thomas A. Ward, 3.4.1 Aviation Fuel, Aerospace Propulsion Systems, Jan. 1, 2010, pp. 202-213, 13 pages.
Partial European Search Report, European Application No. EP 17161582.6, dated Jun. 9, 2017, 15 pages.
Gunderloy F.C., Neblett R.F.; Effect of Phosphorous Deposit Modifiers on Gasoline Octane Quality. Journal of Chemical and Engineering Data. 1963, vol. 7, No. 1; pp. 142-145; 4 pages.

(Continued)

*Primary Examiner* — Ellen M McAvoy
*Assistant Examiner* — Chantel L Graham
(74) *Attorney, Agent, or Firm* — Honigman Miller Schwartz and Cohn LLP

(57) ABSTRACT

Aviation fuel formulations receive many benefits when a manganese-containing additive is incorporated in that composition. However, to the extent that the use of a manganese-containing compound may result in the formation of engine deposits during combustion, it is beneficial to further provide a scavenger compound to the fuel composition. This scavenger compound may include a phosphorus-containing compound, an organobromide compounds, and/or a tricarbonyl compound.

23 Claims, 4 Drawing Sheets

(56) References Cited

U.S. PATENT DOCUMENTS

| | | | |
|---|---|---|---|
| 5,511,517 | A | 4/1996 | Perry et al. |
| 5,851,241 | A | 12/1998 | Studzinski et al. |
| 5,944,858 | A | 8/1999 | Wallace |
| 6,187,064 | B1 | 2/2001 | Henderson |
| 6,238,446 | B1 | 5/2001 | Henderson |
| 6,258,134 | B1 | 7/2001 | Studzinski et al. |
| 6,451,075 | B1 | 9/2002 | Schoppe et al. |
| 6,652,608 | B1 | 11/2003 | Orr |
| 7,572,303 | B2 | 8/2009 | Orr |
| 7,740,668 | B2 | 6/2010 | Gaughan et al. |
| 7,775,166 | B2 | 8/2010 | Aradi et al. |
| 7,833,295 | B2 | 11/2010 | Clark |
| 7,897,034 | B2 | 3/2011 | De Oliviera et al. |
| 8,016,897 | B2 | 9/2011 | Lowery |
| 8,232,437 | B2 | 7/2012 | Clark et al. |
| 8,628,594 | B1 | 1/2014 | Braly |
| 8,734,540 | B2 | 5/2014 | Shea et al. |
| 9,127,225 | B2 | 9/2015 | Shea et al. |
| 2002/0005008 | A1 | 1/2002 | Studzinski |
| 2002/0045785 | A1 | 4/2002 | Bazzani et al. |
| 2003/0040650 | A1 | 2/2003 | Butler et al. |
| 2004/0124122 | A1 | 7/2004 | Clark |
| 2005/0044778 | A1 | 3/2005 | Orr |
| 2005/0188606 | A1 | 9/2005 | Caprotti |
| 2006/0123696 | A1 | 6/2006 | Gaughan et al. |
| 2006/0219096 | A1 | 10/2006 | Aradi et al. |
| 2008/0000148 | A1 | 1/2008 | Cunningham |
| 2008/0005958 | A1 | 1/2008 | Factor |
| 2008/0244963 | A1 | 10/2008 | Demoment et al. |
| 2010/0107480 | A1 | 5/2010 | Lowry |
| 2010/0263262 | A1 | 10/2010 | Gaughan |
| 2011/0114536 | A1 | 5/2011 | Demoment |
| 2012/0000115 | A1 | 1/2012 | Shastri |
| 2012/0029251 | A1 | 2/2012 | Hemighaus et al. |
| 2013/0111805 | A1 | 5/2013 | Mathur et al. |
| 2014/0116367 | A1 | 5/2014 | Braly |
| 2014/0123548 | A1 | 5/2014 | Braly |
| 2014/0128644 | A1 | 5/2014 | Braly |
| 2015/0113861 | A1 | 4/2015 | Shea et al. |
| 2015/0113862 | A1 | 4/2015 | Shea et al. |
| 2015/0113866 | A1 | 4/2015 | Shea et al. |
| 2015/0175920 | A1 | 6/2015 | Shea et al. |
| 2015/0175921 | A1 | 6/2015 | Shea et al. |
| 2015/0259616 | A1 | 9/2015 | Albuzat et al. |

FOREIGN PATENT DOCUMENTS

| | | | |
|---|---|---|---|
| AU | 2005201102 | B2 | 4/2005 |
| CA | 2310056 | A1 | 12/1999 |
| CA | 2256042 | C | 7/2006 |
| EP | 0609089 | A1 | 8/1994 |
| EP | 0910617 | B1 | 7/2003 |
| FR | 1162768 | | 9/1958 |
| GB | 708006 | | 4/1954 |
| GB | 872820 | A | 7/1961 |
| GB | 898343 | | 6/1962 |
| GB | 900446 | | 7/1962 |
| GB | 936364 | | 9/1963 |
| GB | 946062 | | 1/1964 |
| GB | 969913 | | 9/1964 |
| GB | 1343907 | | 1/1974 |
| GB | 2248068 | | 3/1992 |
| JP | 3660357 | B2 | 6/2005 |
| JP | 2005272850 | A | 10/2005 |
| RU | 2314334 | | 1/2008 |
| WO | 9640844 | A1 | 12/1996 |
| WO | 9826028 | A1 | 6/1998 |
| WO | 0222766 | A1 | 3/2002 |
| WO | 2005087901 | A2 | 9/2005 |
| WO | 2012015506 | A1 | 2/2012 |
| WO | 2015197855 | A1 | 12/2015 |
| WO | 2016010966 | A1 | 1/2016 |
| WO | 2017123314 | | 7/2017 |

OTHER PUBLICATIONS

International Application Serial No. PCT/US/16/60749; Notification of Transmittial of the International Search Report and the Written Opinion of the International Searching Authority; 16 pages, dated Jan. 13, 2017.

Livingston H.K.; Antiknock Antogonists. Industrial and Engineering Chemistry. 1951, vol. 43 No. 3; pp. 663-671; 9 pages.

SAR Map of Phosphorous Scavengers

FIGURE 3

Tricarbonyl Scavenger Testing

| Fuel | mmt (mg Mn/L) | Triethyl 1,1,2-ethanetricarboxylate (mg/L) | Glycerol Triacetate (mg/L) | ASTM D2700 MON |
|---|---|---|---|---|
| EEE | 0 | 0 | 0 | 88.5 |
| EEE | 125 | 0 | 0 | 91.2 |
| EEE | 125 | 75 | 0 | 91.1 |
| EEE | 125 | 0 | 75 | 90.9 |

AVIATION FUEL ADDITIVE SCAVENGER

This invention relates to aviation fuel additives and specifically to a scavenger mixed and used in the additive and eventual fuel compositions. The scavenger is used together with a manganese-containing additive component to reduce and/or modify the formation of engine deposits otherwise caused by the combustion of the aviation fuel.

BACKGROUND

Current and future regulations with respect to aviation fuel compositions include a no-lead requirement. Aviation fuel compositions therefore, are challenged to include components that replace the positive performance features that are a result from the incorporation of lead in aviation fuels. These challenges include meeting the rating number octane requirements of an aviation fuel composition and managing engine deposits that result from the combustion of new formulations of aviation fuels, including but not limited to manganese-containing additives. Unfortunately, the solution for some of these performance specifications can cause problems with respect to other performance specifications. The unique aviation fuel requirements present these previously unsolved challenges.

SUMMARY

Accordingly, it is an objective of the present invention to overcome the challenges with formulating new aviation fuel compositions that include manganese-containing compounds. In one example, an aviation fuel additive composition comprises a cyclopentadienyl manganese tricarbonyl compound and a manganese scavenger compound. The manganese scavenger compound may comprise a phosphorus-containing compound, an organobromide compound, or a tricarbonyl compound. The phosphorus-containing compound may be selected from the group consisting of tritolyl phosphate, triphenyl phosphate, triisopropyl phosphate, dimethyl methyl phosphonate, triphenyl phosphine oxide, and triphenyl phosphine. The organobromide compound may be selected from the group consisting of 1,2-dibromoethane; 3,5-dibromotoluene; 2,5-dibromotoluene; and 2,6-dibromo-4-methylaniline. And the manganese scavenger may be comprised of a tricarbonyl compound selected from the group consisting of glycerol triacetate; triethyl 1,1,2-ethanetricarboxylate; triethyl citrate, and tributyl citrate. The cyclopentadienyl manganese tricarbonyl may comprise methylcyclopentadienyl manganese tricarbonyl. The amount of methylcyclopentadienyl manganese tricarbonyl may equal about 1 to 500 mg/l of the additive composition.

A method of reducing manganese-containing deposits that result from the combustion of an aviation fuel including a cyclopentadienyl manganese tricarbonyl includes several steps. First, at least one scavenger provided is selected from the group consisting of phosphorus-containing compound, an organobromide compound, or a tricarbonyl compound. This scavenger is then mixed with a substantially lead-free aviation fuel composition that further comprises a cyclopentadienyl manganese tricarbonyl. The fuel and scavenger mixture is then combusted in an aviation fuel, spark ignition engine, wherein the combustion results in less and/or modified engine deposits than the combustion of a fuel composition without a scavenger in a comparable engine.

BRIEF DESCRIPTION OF THE DRAWINGS

FIG. 3 is a table that demonstrates the effect of exemplary tricarbonyl scavengers on rating octane numbers of a reference fuel treated with a manganese-containing compound.

DETAILED DESCRIPTION

Figure 1:
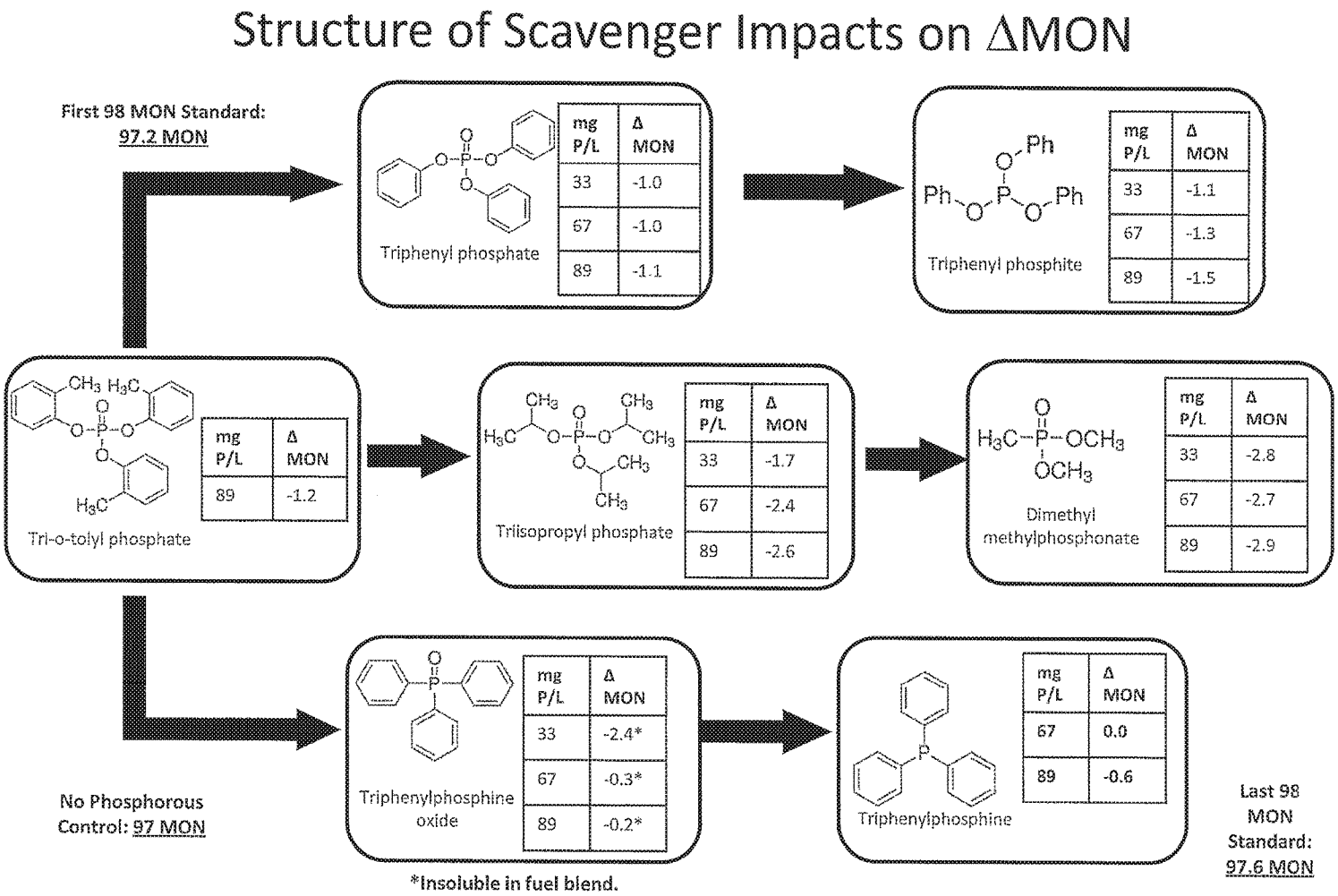
FIG. 1 is a chart that illustrates several phosphorus-containing scavengers together with their relative impact on the rating number octane of the resulting fuel.
Figure 2:
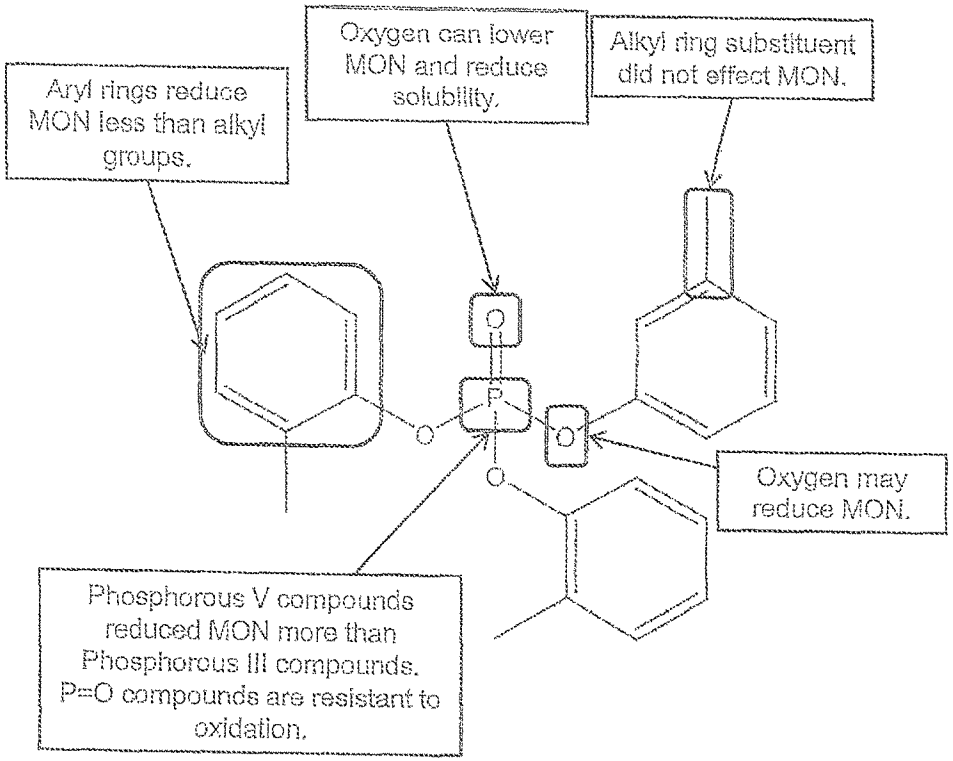
FIG. 2 is a structure-activity-relationship (SAR) map of phosphorus scavengers.

Use of any fuel additives in connection with aviation fuel compositions can be and often is different from the use of additives in connection with vehicle motor fuels. In vehicle fuels, there is a great concern with respect to engine emissions. In aviation fuels, an emphasis is consistent and reliable engine performance. This sometimes-different emphasis means advances in one type of fuel formulation can be different from and counterintuitive to those different formulations as they may not be applicable in the other setting.

The present invention is a scavenger used in aviation fuel compositions and additives used to formulate finished aviation fuel compositions. Specifically, the purpose of the scavenger described herein is to scavenge manganese, and specifically thereby reduce and/or modify the manganese-containing engine deposits that can form in spark-ignited aviation engines. By reducing or modifying the manganese-containing deposits, for instance manganese oxide deposits, the aviation engine performance is made more consistent and reliable.

The aviation fuels relevant to the discussion herein also include manganese-containing additives. These additives are typically, but not limited to, cyclopentadienyl manganese tricarbonyl compounds.

Cyclopentadienyl manganese tricarbonyl compounds which can be used in the practice of the fuels herein include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tertbutylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. The aviation fuels of this invention will contain an amount of one or more of the foregoing cyclopentadienyl manganese tricarbonyl compounds sufficient to provide the requisite octane number and valve seat wear performance characteristics.

For the purposes of this application, a fuel composition is described in ASTM 4814 as substantially "lead-free" or "unleaded" if it contains 13 mg of lead or less per liter (or about 50 mg Pb/gal or less) of lead in the fuel. Alternatively, the terms "lead-free" or "unleaded" mean about 7 mg of lead or less per liter of fuel. Still further alternatively, it means an essentially undetectable amount of lead in the fuel composition. In other words, there can be trace amounts of lead in a fuel; however, the fuel is essentially free of any detectable amount of lead. It is to be understood that the fuels are unleaded in the sense that a lead-containing antiknock agent is not deliberately added to the gasoline. Trace amounts of lead due to contamination of equipment or like circumstances are permissible and are not to be deemed excluded from the fuels described herein.

The aviation fuel composition as described herein typically contains aviation alkylate components. Those components may comprise about 10 to 80 volume percent of the fuel. Aromatic hydrocarbons may be incorporated into the fuel to improve the octane rating of the fuel. These aromatic hydrocarbons are incorporated according to one example of the present invention at a rate of about zero to 30 volume percent of the fuel composition. In another example, the aromatic hydrocarbons are incorporated at a rate of about 10 to 20 volume percent of the fuel composition.

The fuel blend may contain aromatic gasoline hydrocarbons, at least a major proportion of which are mononuclear aromatic hydrocarbons such as toluene, xylenes, the mesitylenes, ethyl benzene, etc. Mesitylene is particularly preferred in one embodiment. Other suitable optional gasoline hydrocarbon components that can be used in formulating the aviation fuels described herein include isopentane, light hydrocracked gasoline fractions, and/or $C_{5-6}$ gasoline isomerate.

Other components which can be employed, and under certain circumstances are preferably employed, include dyes which do not contribute to excessive induction system deposits. Typical dyes which can be employed are 1,4-dialkylaminoanthraquinone, p-diethylaminoazobenzene (Color Index No. 11020) or Color Index Solvent Yellow No. 107, methyl derivatives of azobenzene-4-azo-2-naphthol (methyl derivatives of Color Index No. 26105), alkyl derivatives of azobenzene-4-azo-2-naphthol, or equivalent materials. The amounts used should, wherever possible, conform to the limits specified in ASTM Specification D 910-90.

The amount of manganese-containing additives can be varied according to the base fuels and the other additives being incorporated with the fuel. It is expected that the amount of manganese added is in the range of about 1 to 500 mg Mn/l of the finished fuel, or alternatively about 5 to 250 mg Mn/l, or still further alternatively about 125 to 225 mg Mn/l. The additive concentration will vary depending on the target concentration of the end fuel composition and the relative volume amounts of additive and base fuel being combined.

The manganese scavenger compound may be any compound that interacts with the manganese-containing additive component. By "scavenging" herein is meant the contacting, combining with, reacting, incorporating, chemically bonding with or to, physically bonding with or to, adhering to, agglomerating with, affixing, inactivating, rendering, inert, consuming, alloying, gathering, cleansing, consuming, or any other way or means whereby a first material makes a second material unavailable or less available. Examples of manganese scavengers include phosphorus-containing compounds, organobromide compounds, and tricarbonyl compounds.

Among the phosphorus compounds useful in the present compositions are both inorganic and organic compounds. Typical inorganic phosphorus compounds include phosphonitrilic dichloride, phosphorus sesquisulfide, and the like. Typical organic compounds include the trivalent esters of phosphorus such as triphenyl phosphite, triethyl phosphite, diethyl phosphite, trimethyl phosphite, tri-secoctyl phosphite, tri(fi-chloroethylphosphite, and the like.

Another suitable class includes the pentavalent esters of phosphorus acids. Examples of these both in the alkyl and aryl categories include trimethyl phosphate, trimethyl thionophosphate, triethyl phosphate, tributyl phosphate, triisoamyl phosphate, dimethylphenyl phosphate, tri(β-chloropropyl)thionophosphate, tricresyl phosphate, dimethyl monoxylo phosphate, etc. Dimethyl monoaryl phosphates such as dimethyl phenyl phosphate may also be used.

Among the phosphorus compounds containing carbon-to-phosphorus bonds, the phosphines such as trimethyl phosphine, triethyl phosphine, trioctyl phosphine, triphenyl phosphine and the like may be used. Tertiary phosphine oxides such as trimethyl phosphine oxide, tripropyl phosphine oxide, triphenyl phosphine oxide and analogous phosphine sulfides such as triisobutyl phosphine sulfide and tribenzyl phosphine sulfide are also useful. Another class of suitable phosphorus compounds include the phosphonates such as diethyl methane phosphonate, diethyl propane phosphonate, dibutyl isoprene phosphonate, etc.

Various more complex phosphorus compounds such as the $P_2S_5$-active hydrogen compound reaction products, can also be employed, as can nitrogen-containing compounds such as aminophosphates, amidophosphites and sulfur analogs thereof.

Still further phosphorus compounds including the following:

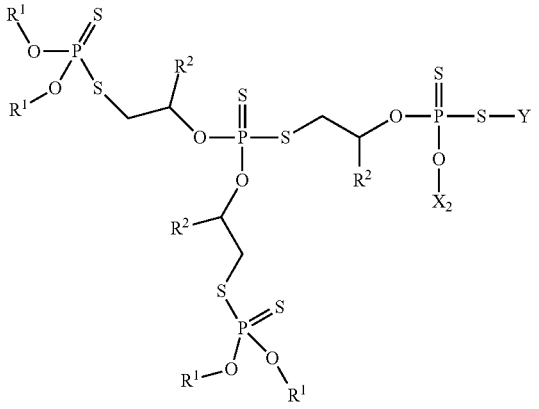

or a tribologically acceptable salt thereof, each $R^1$ is the same or different and is independently selected from alkyl, alkenyl, cycloalkyl, cycloalkylalkyl, aryl, and aralkyl, wherein said aryl and aralkyl are optionally substituted with one to three substituents each independently selected from alkyl and alkenyl;

each $R^2$ is independently selected from alkyl, alkenyl, cycloalkyl and cycloalkylalkyl;

Y is selected from the group consisting of alkyl, alkoxyalkyl, benzyl, and —$R^4$—$R^5$—$R^6$;

$R^4$ is alkylene;

$R^5$ is selected from the group consisting of a bond, alkylene; —C(O)— and —C($R^7$)—;

$R^6$ is selected from the group consisting of alkyl, hydroxyalkyl, hydroxyalkyleneoxy, hydroxy and alkoxy;

$R^7$ is hydroxy;

$X_2$ is selected from the group consisting of $R^8$,

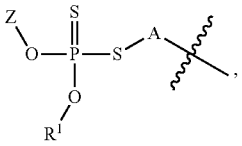

and

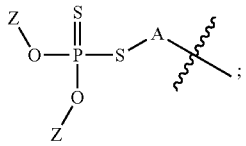

$R^8$ is alkyl, alkenyl, cycloalkyl, cycloalkylalkyl, aryl, and aralkyl, wherein said aryl and aralkyl are optionally substituted with one to three substituents each independently selected from alkyl and alkenyl; and Z is

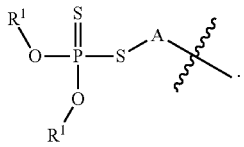

The amount of phosphorus-containing compounds to be added can be varied. As a manganese scavenger, the amount of elemental phosphorus will correlate by some effective stoichiometric ratio with the amount of manganese in the additive or fully formulated fuel composition. This stoichiometric ratio of Mn:P may be from about 1:0.1 to 1:10, or alternatively 1:0.5 to 1:3.

It is also possible, and perhaps expected, that two or more phosphorus-containing compounds may be used. The different compounds may have different scavenging efficiencies. Different manganese-containing compounds may react differently with the different phosphorus compounds. Additionally, different phosphorus-containing compounds may have differing impacts on the rating number octane or other performance characteristics of an aviation fuel. Combinations of a plurality of phosphorus compounds may therefore be chosen to respond to the balance of their effects in the aviation fuel composition.

The organobromide scavenger compounds that may be used include the following: an organobromide compound selected from the group consisting of 1,2-dibromoethane; 3,5-dibromotoluene; 2,5-dibromotoluene; and 2,6-dibromo-4-methylaniline. Other possible organobromides are aryl organobromides, including but not limited to, substituted aryl bromides where the substituted group is between 1-5 substituents and can be an amine, alkyl group, aryl group, halide other than bromine, additional nitrogen containing groups, and phosphorous containing groups. Aromatic groups are not limited to benzene. For example naphthalene and other rings that meet the criteria for aromaticity may be used. This includes heteroaryl rings that contain nitrogen, oxygen, or sulfur. Alkyl organobromides (for instance, 1,2-dibromoethane) having an alkyl size of 1-15 carbons are also possible. Alkyl bromides can be straight chain, branched, or contain aromatic and cycloalkyl ring structures. They can also contain other elements such as nitrogen, phosphorous, oxygen, and sulfur.

The amount of organobromide scavenger compound will be proportional to the amount of manganese in the fuel additive or finished fuel composition. The amount may range from the stoichiometric ratio of Mn:Br of about 1:0.1 to 1:20, or alternatively, about 1:4 to 1:8.

Different organobromides may be used as determined by their effectiveness with a given manganese compound. Also, combinations of organobromides may be used.

The tricarbonyl scavenger compounds that may be used include the following: a tricarbonyl selected from the group consisting of glycerol triacetate; triethyl 1,1,2-ethanetricarboxylate; triethyl citrate, and tributyl citrate. Other possible tricarbonyls include a tricarbonyl selected from the group consisting of glycerol triacetate; triethyl 1,1,2-ethanetricarboxylate; triethyl citrate, and tributyl citrate. Other possible tricarbonyls include compounds that contain ethyl or linear propyl backbones as well as three carbonyl groups. The carbonyl groups can be directly bonded to the backbone as in triethyl 1,1,2-ethanetricarboxylate or separated by a spacer atom such as oxygen, sulfur, nitrogen, or phosphorous atom, for example glycerol triacetate. Further substituents, either singly or in combination, can be attached to the backbone including: alkyl, cycloalkyl, alkenyl, alkynyl, or aryl groups. Additionally groups containing elements such as oxygen, nitrogen, sulfur, chlorine, fluorine, bromine, and phosphorous can be attached to the backbone as in the cases of triethyl and tributyl citrate. The identity of the carbonyl group is typically an ester but can be a thioester, ketone, amide, or aldehyde. Substituents on the carbonyl group can be alkyl, cycloalky, alkenyl, alkynyl, or aryl groups. These substituents can contain heteroatoms such as oxygen, nitrogen, sulfur, chlorine, fluorine, bromine, and phosphorous. Functional groups that limit the storage stability, reduce scavenger solubility in fuel, or make the compound excessively or insufficiently volatile are disfavored.

The amount of tricarbonyl scavenger compound will be proportional to the amount of manganese in the fuel additive or finished fuel composition. The amount may range from 1:0.05 to 1:10 mass ratio of Mn to tricarbonyl. In particular a 1:0.5 to 1:3 mass ratio of Mn to scavenger may be used.

Different tricarbonyls and combinations of two or more tricarbonyls may be used as determined by their overall effectiveness with a given manganese compound and overall fuel composition.

In addition to each singular class of manganese scavengers, it is possible and intended that different scavengers from different classes of compounds may be used. In other words, one or more phosphorus-containing compounds may be combined and used with one or more organobromide compounds; one or more phosphorus-containing compounds may be combined and used with one or more tricarbonyl compounds; one or more tricarbonyl compounds may be used with one or more organobromide compounds; or, one or more phosphorus-containing compounds, one or more organobromide compounds, and one or more tricarbonyl compounds may all be combined and used together.

Example 1

Structure of Scavenger Impacts ΔMON (Phosphorus-Containing Compound)

There are many benefits associated with the use of a scavenger when a manganese-containing additive is used with aviation fuel formulations. However, phosphorus-containing scavengers may impact the motor octane number (MON) when employed with a fuel formulation. FIG. 1 illustrates several examples of phosphorus-containing scavenger compounds. In each case, the treat rate of that compound, in mg P/l is indicated together with the effect or difference in motor octane number between no use and use of the particular phosphorus-containing compound. As shown in FIG. 1, a superior phosphorus-containing scavenger is shown as triphenylphosphine.

Example 2

SAR Map of Phosphorous Scavengers

In order to explain the different effects on motor octane number with respect to different phosphorus-containing scavenger compounds, conclusions can be theorized based on the examples of phosphorus-containing scavenger as shown as FIG. 1. As illustrated and explained, different functional groups in the phosphorus scavenger have apparent effects with respect to the motor octane number and other physical attributes.

Example 3

Tricarbonyl Scavenger Testing

To different tricarbonyl scavenger compounds were tested as compared with a base fuel and a fuel additized with a manganese-containing compound. Based on the table of FIG. 3, it can be seen that the tricarbonyl scavengers have substantially no effect on the motor octane number of the fuel. The small reduction shown in motor octane numbers are almost negligible.

Example 4

Tricarbonyl Scavenger Testing

Figure 4:
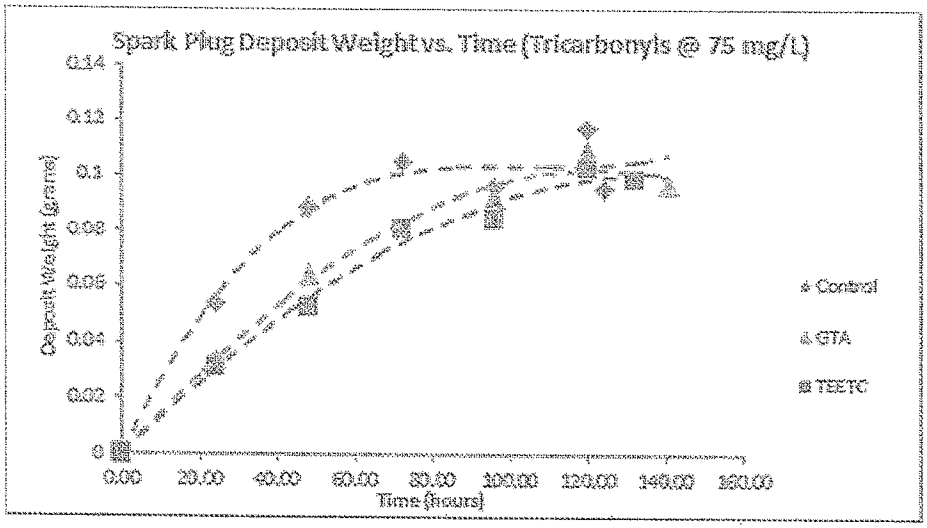
FIG. 4 is graph that illustrates the deposit rate of manganese-containing deposits when combined with tricarbonyl additives.

The specific effects and benefits from the use of a tricarbonyl scavenger in the context of spark plug deposits as shown in FIG. 4. In that graph, the deposits can be shown as being significantly less during the life of the test up until approximately 120 hours.

As shown, a reduction in engine deposits is a positive result when employing a scavenger as described herein. In addition to reducing deposits, those deposits may also be modified. For instance, instead of manganese oxide engine deposits, those deposits may instead be manganese phosphate or other manganese compounds that are less harmful. For instance, these alternative compounds may form and better able to be blown out of the engine during operation rather than growing deposits on the engine during operation.

These specific engine deposits that are reduced and/or modified include manganese-containing deposits formed on engine components such as spark plugs, intake valves, exhaust valves, and combustion chambers. These different locations of deposits may affect engine operation differently. It is believed that the reduction and/or modification of deposits using a scavenger as described herein is able to improve performance for liability of the engine overall.

Other embodiments of the present disclosure will be apparent to those skilled in the art from consideration of the specification and practice of the disclosure disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

What is claimed is:

1. An aviation fuel additive composition comprising a cyclopentadienyl manganese tricarbonyl compound and a manganese scavenger compound, wherein the manganese scavenger compound is selected from triphenyl phosphine oxide, a triphenyl phosphine, and a tricarbonyl compound.

2. An aviation fuel additive composition as described in claim 1, wherein the manganese scavenger compound is triphenyl phosphine oxide, triphenyl phosphine, or mixtures thereof and which is present in an amount to be a stoichiometric ratio of Mn to P of from about 1:0.1 to 1:10.

3. An aviation fuel additive composition as described in claim 1, wherein the cyclopentadienyl manganese tricarbonyl comprises methylcyclopentadienyl manganese tricarbonyl.

4. An aviation fuel additive composition as described in claim 3, wherein an amount of the methylcyclopentadienyl manganese tricarbonyl in the aviation fuel additive composition is sufficient to provide equals about 1 to 500 mg Mn/l to an aviation fuel composition.

5. An aviation fuel additive composition as described in claim 1, wherein the manganese scavenger compound is the tricarbonyl compound and selected from the group consisting of glycerol triacetate; triethyl 1, 1, 2-ethanetricarboxylate; triethyl citrate, and tributyl citrate.

6. An aviation fuel additive composition as described in claim 5, wherein an amount of the tricarbonyl compound relative to an amount of manganese in the fuel additive is from about 1:0.05 to 1:10 mass ratio of manganese to tricarbonyl.

7. An aviation fuel additive composition as described in claim 5, wherein the cyclopentadienyl manganese tricarbonyl comprises methylcyclopentadienyl manganese tricarbonyl.

8. An aviation fuel additive composition as described in claim 7, wherein an amount of the methylcyclopentadienyl manganese tricarbonyl is sufficient to provide about 1 to 500 mg Mn/l to an aviation fuel composition.

9. An aviation fuel additive composition comprising:

(a) an amount of one or more cyclopentadienyl manganese tricarbonyl compounds sufficient to provide about 0.5 to 500 mg Mn/l to an aviation fuel composition, (b) a scavenger selected from triphenyl phosphine oxide, triphenyl phosphine, and tricarbonyl compounds, and wherein the composition is substantially lead free.

10. An aviation fuel additive composition as described in claim 9, wherein the scavenger is triphenyl phosphine oxide, triphenyl phosphine, or mixtures thereof and which is present in an amount to be a stoichiometric ratio of Mn to P of from about 1:0.1 to 1:10.

11. An aviation fuel additive composition as described in claim 9, wherein the cyclopentadienyl manganese tricarbonyl comprises methylcyclopentadienyl manganese tricarbonyl.

12. An aviation fuel additive composition as described in claim 9, wherein the scavenger is the tricarbonyl compound and selected from the group consisting of glycerol triacetate; triethyl 1, 1, 2-ethanetricarboxylate; triethyl citrate, and tributyl citrate.

13. An aviation fuel additive composition as described in claim 9, wherein the scavenger compound is a plurality of phosphorus-containing compounds.

14. An aviation fuel additive composition as described in claim 9, wherein the scavenger compound comprises phosphorus-containing compound and a tricarbonyl compound.

15. A method of reducing manganese-containing deposits resulting from the combustion of an aviation fuel including a cyclopentadienyl manganese tricarbonyl in an aviation fuel engine, the method comprising the steps of:

providing a scavenger selected from triphenyl phosphine oxide, triphenyl phosphine, and tricarbonyl compounds;

mixing the scavenger with a substantially lead-free aviation fuel composition, wherein the aviation fuel composition further comprises a cyclopentadienyl manganese tricarbonyl; and combusting the fuel composition and scavenger mixture in an aviation, spark ignition engine;

wherein the combustion results in less manganese-containing engine deposits than the combustion of a fuel composition without a scavenger in a comparable engine.

16. A method of reducing manganese-containing deposits as claimed in claim 15, wherein the manganese-containing deposits that are formed during combustion are different from the manganese-containing deposits that are formed during the combustion of a fuel composition without a scavenger.

17. A method of reducing manganese-containing deposits as claimed in claim 15, wherein the manganese-containing deposits are formed on engine components selected from the group consisting of spark plugs, intake valves, exhaust valves, and combustion chambers.

18. An aviation fuel additive composition as described in claim 1, wherein the manganese scavenger compound is triphenyl phosphine oxide, triphenyl phosphine, or mixtures thereof.

19. An aviation fuel additive composition as described in claim 9, wherein the scavenger is triphenyl phosphine oxide, triphenyl phosphine, or mixtures thereof.

20. A method of reducing manganese-containing deposits resulting from the combustion of an aviation fuel including a cyclopentadienyl manganese tricarbonyl in an aviation fuel engine as described in claim 15, wherein the scavenger is triphenyl phosphine oxide, triphenyl phosphine, or mixtures thereof.

21. The aviation fuel additive composition as described in claim 1, wherein the manganese scavenger compound is the tricarbonyl compound and selected from glycerol triacetate, triethyl 1, 1,2-ethanetricarboxylate, and mixtures thereof.

22. The aviation fuel additive composition as described in claim 9, wherein the scavenger is the tricarbonyl compound and selected from glycerol triacetate, triethyl 1, 1,2-ethanetricarboxylate, and mixtures thereof.

23. The aviation fuel additive composition as described in claim 22, wherein an amount of the tricarbonyl compound relative to an amount of manganese in the aviation fuel additive is from about 1:0.05 to 1:10 mass ratio of manganese to tricarbonyl.

* * * * *